US005135348A

United States Patent [19]

Kishi et al.

[11] Patent Number: 5,135,348

[45] Date of Patent: Aug. 4, 1992

[54] EARTH-WORKING MACHINE

[75] Inventors: Mitsuhiro Kishi; Yokichi Nagasawa, both of Ashikaga, Japan

[73] Assignee: Kabushiki Kaisha Hikoma Seisakusho, Tochigi, Japan

[21] Appl. No.: 622,391

[22] Filed: Nov. 29, 1990

Related U.S. Application Data

[63] Continuation of Ser. No. 302,118, Jan. 24, 1989, abandoned, which is a continuation of Ser. No. 60,984, Jun. 10, 1987, abandoned, which is a continuation of Ser. No. 705,998, Feb. 27, 1985, abandoned.

[30] Foreign Application Priority Data

Mar. 6, 1984 [JP] Japan ..... 59-42771
Mar. 6, 1984 [JP] Japan ..... 59-42772

[51] Int. Cl.[5] ..... E02F 5/02
[52] U.S. Cl. ..... 414/695.8; 212/245
[58] Field of Search ..... 414/687, 694, 695, 695.5, 414/695.7, 695.8, 698; 91/514–516; 212/245–248

[56] References Cited

U.S. PATENT DOCUMENTS 287,631 10/1883 Cook ..... 212/247 X
1,528,222 3/1925 Miller ..... 212/248 X
4,335,894 6/1982 Swanson ..... 91/515 X
4,433,495 2/1984 Kishi ..... 414/694 X
4,596,508 6/1986 Kishi et al. ..... 414/694 X

FOREIGN PATENT DOCUMENTS 57-205637 12/1982 Japan .
57-205639 12/1982 Japan .
0971028 9/1964 United Kingdom .

*Primary Examiner*—Robert J. Spar
*Assistant Examiner*—Donald W. Underwood
*Attorney, Agent, or Firm*—Koda and Androlia

[57] ABSTRACT

An earth-working machine includes a mobile chassis, a turntable rotatably mounted on the mobile chassis, a carriage rotatably mounted on the turntable in eccentric relation thereto, an earth-working mechanism mounted on the carriage, a source of a fluid pressure, a pair of first and second fluid motors for rotating the turntable and the carriage, respectively, and a fluid rate synchronizer composed of a pair of third and fourth fluid motors interconnected by a common output shaft for discharging amounts of fluid under pressure at a predetermined ratio, the source being operatively coupled to the third and fourth fluid motors, the first and second fluid motors being operatively coupled to the third and fourth fluid motors, respectively, whereby the turntable and the carriage will be angularly moved about their own axes at a constant angular displacement ratio. First and second position detectors are provided for respectively detecting a first angular position of the turntable with respect to the mobile chassis and a second angular position of the carriage with respect to the turntable. An electric control circuit controls solenoid-operated valves to stop the rotation of the first and second fluid motors when the first and second angular positions are reached.

12 Claims, 11 Drawing Sheets

EARTH-WORKING MACHINE

This is a continuation of application Ser. No. 302,118 filed Jan. 24, 1989, now abandoned which is a continuation of application Ser. No. 060,984, filed Jun. 10, 1987, now abandoned, which is a continuation of application Ser. No. 705,998, filed Feb. 17, 1985, also abandoned.

BACKGROUND OF THE INVENTION

The present invention relates to an earth-working machine such as an excavator for digging ditches in road construction, and more particularly to an earth-working machine having a turntable and a carriage which are driven by respective hydraulic motors so as to be controllably angularly movable independently on a self-propelled mobile chassis for enabling an excavating mechanism on the carriage to turn in various angular ranges for avoiding interference with surrounding traffic and/or objects and providing wide working areas for the excavating mechanism.

Conventional earth-working machines or excavators include an excavating mechanism composed of a boom or bucket arm having a bucket on its distal end for trenching a ditch in a road. In operation, the material scooped by the bucket is transferred back by turning the boom around the machine. Since the boom is angularly moved through an semicircular angule range, the boom and the bucket as they move project laterally of the machine, resulting in the danger of interfering with surrounding traffic and/or objects. Therefore, a large working radius or range clear of any obstructions should be reserved around the machine for allowing safe swinging movement of the boom. This requirement however is difficult or even impossible to meet in situations where only relativey small or limited spaces are available for the machine.

To eliminate such a difficulty, there has been proposed an excavator having a turntable rotatably mounted on a mobile chassis and a carriage rotatably mounted on the turntable and supporting an excavating mechanism, the turntable and the carriage having shafts positioned out of coaxial relation. With this arrangement, the bucket on the boom is allowed to move over the chassis without appreciably projecting laterally thereof when the turntable and the carriage are turned about their shafts. Therefore, unwanted interference with traffic or objects is prevented around the machine, and the excavator can be placed in relatively small spaces for road construction or other earth-moving applications. The proposed excavator are however less resistant to vibrations and susceptible to adverse environments. Another problem is that the turntable and the chassis which are driven by respective hydraulic motors tend to be brought out of synchronism when they are operated for a long time. Therefore, it has been necessary to correct the relative angular positions of the turntable and the chassis by independently operating the hydraulic motors. Such angular positional adjustments have heretofore been carried out by a manual operation, which is time-consuming, troublesome, and not reliable sufficiently.

SUMMARY OF THE INVENTION

It is an object of the present invention to provide an earth-working machine having a turntable and a carriage mounted on the turntable and supporting an excavating mechanism, and a hydraulic circuit including a fluid rate synchronizer for supplying equal amounts of fluid from a hydraulic pressure source to respective hydraulic motors to rotate the turntable and the carriage at a constant angular displacement ratio.

Another object of the present invention is to provide an earth-working machine having a turntable and a carriage supporting thereon an excavating mechanism, and a position setting mechanism for setting the turntable and the carriage to relative angular positions, respectively.

According to the present invention, an earth-working machine includes a mobile chassis, a turntable rotatably mounted on the mobile chassis, a carriage rotatably mounted on the turntable in eccentric relation thereto, an earth-working mechanism mounted on the carriage, a source of a fluid pressure, a pair of first and second fluid motors for rotating the turntable and the carriage, respectively, and a fluid rate synchronizer composed of a pair of third and fourth fluid motors interconnected by a common output shaft for discharging amounts of fluid under pressure at a predetermined ratio, the source being operatively coupled to the third and fourth fluid motors, the first and second fluid motors being operatively coupled to the third and fourth fluid motors, respectively, whereby the turntable and the carriage will be angularly moved about their own axes at a constant angular displacement ratio. Since the first and second fluid motors can be controlled by the fluid rate synchronizer to rotate the turntable and carriage at the constant angular displacement ratio. The fluid control synchronizing arrangement is smaller in size, simpler in construction, and hence can be maintained with more ease than mechanical synchronizing structures, and is more resistant to vibrations, heat, and other adverse environmental conditions than electronic controls. The fluid rate synchronizer of the invention can achieve a higher rate control accuracy than possible with a fluid control arrangement using a flow dividing valve. The earth-working machine also includes a pair of first and second normally closed solenoid-operated valves connected across the third and fourth fluid motors, respectively, for providing bypass passages respectively across the third and fourth fluid motors when the first and second normally closed solenoid-operated valves are actuated.

According to another embodiment of the present invention, the earth-working machine also includes a pair of first and second normally open solenoid-operated valves, the first normally open solenoid-operated valve being operatively connected between the first and third fluid motors, the second normally open solenoid-operated valve being operatively connected between the second and fourth fluid motors, and an electrical control circuit including a first switch for simultaneously actuating the first normally closed solenoid-operated valve and the second normally open solenoid-operated valve, and a second switch for simultaneously actuating the second normally closed solenoid-operated valve and the first normally open solenoid-operated valve. The electric control circuit includes a first position detector for detecting a first angular position of the turntable with respect to the mobile chassis, and a second position detector for detecting a second angular position of the carriage with respect to the turntable, the first position detector including a third switch connected parallel to the first switch for simultaneously actuating the first normally closed solenoid-operated valve and the second normally open solenoid-operated valve when the first angular position is detected, and the second position detector including a fourth switch connected parallel to the second switch for simultaneously actuating the first normally closed solenoid-operated valve and the second normally open solenoid-operated valve when the second angular position is detected. When the turntable and the carriage are subjected to an angular positional error, they may be corrected into desired synchronized angular positions by automatically stopping the turntable and the carriage at their first and second angular positions.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
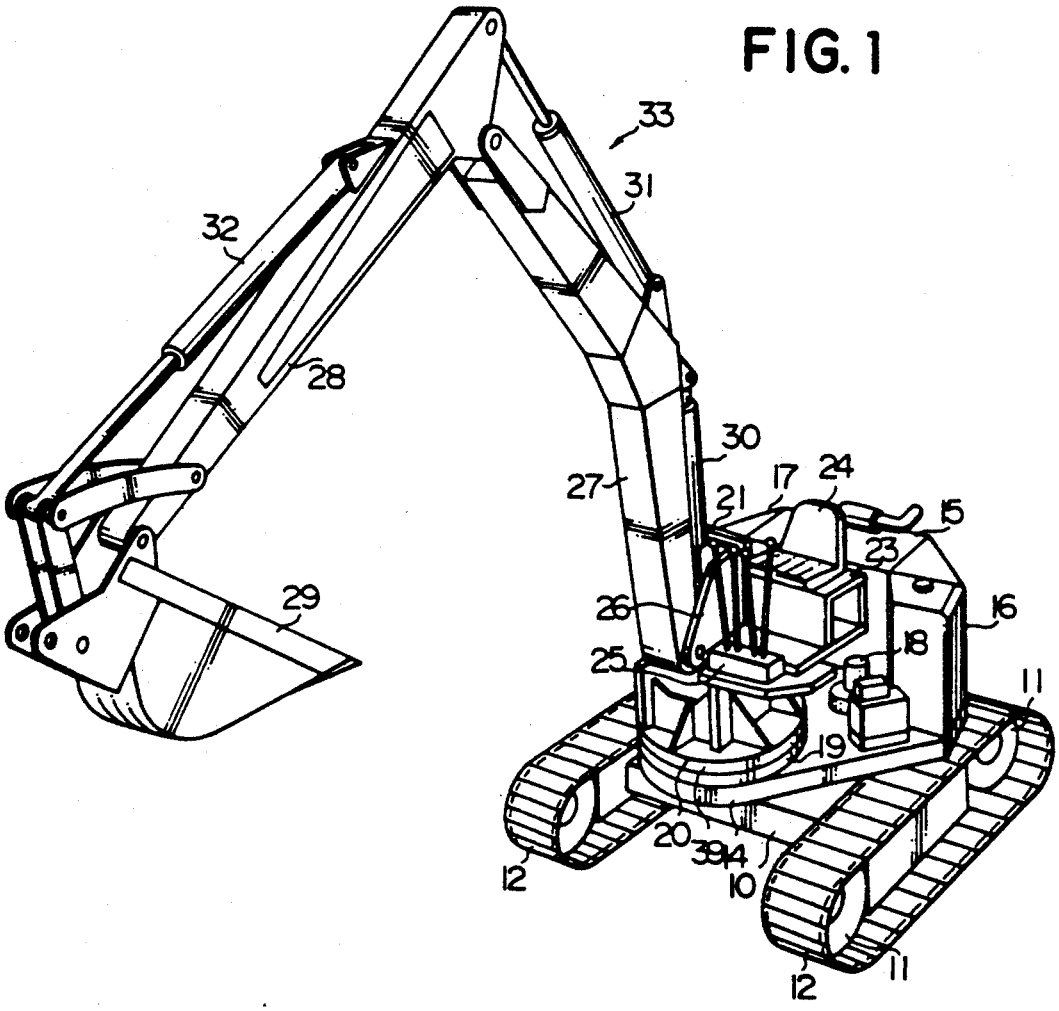
FIG. 1 is a perspective view of an excavator according to the present invention.

The present invention is particularly useful when embodied in an earth-working machine such as an excavator or trenching machine as shown in the drawings. Like or corresponding parts are denoted by like or corresponding reference characters throughout the views.

Figure 2:
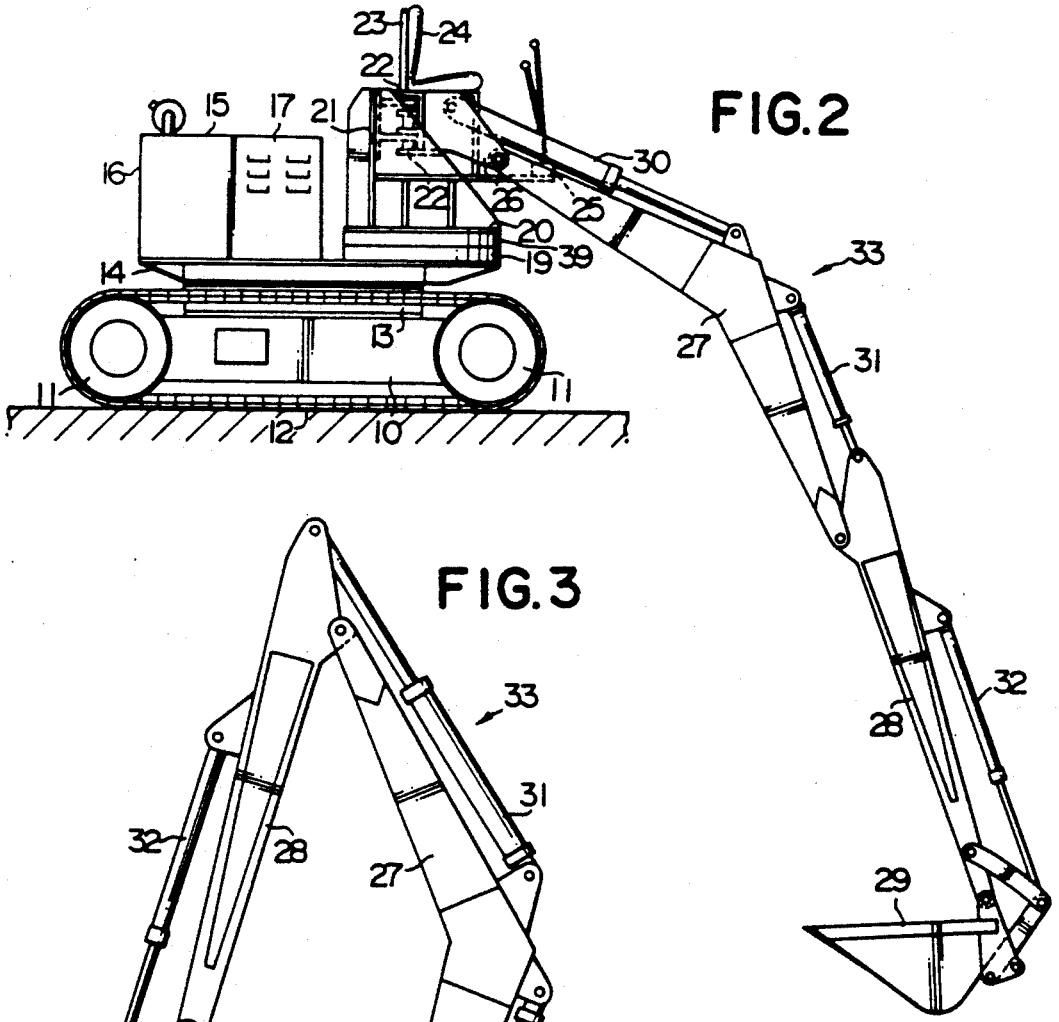
FIG. 2 is a side elevational view of the excavator shown in FIG. 1.
Figure 3:
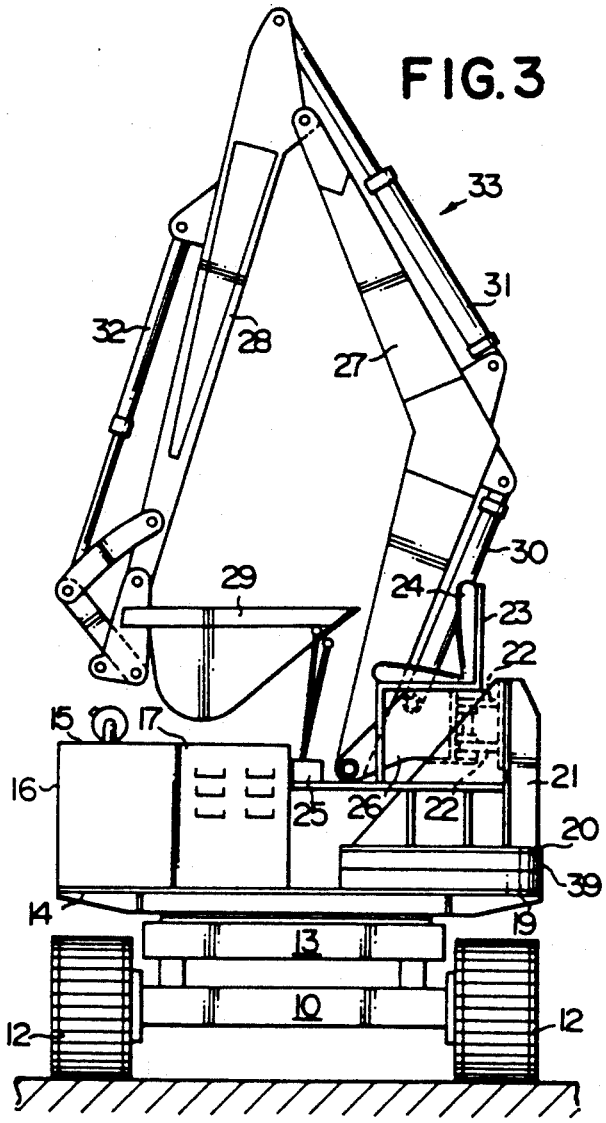
FIG. 3 is a front elevational view of the excavator of FIG. 1.
Figure 4:
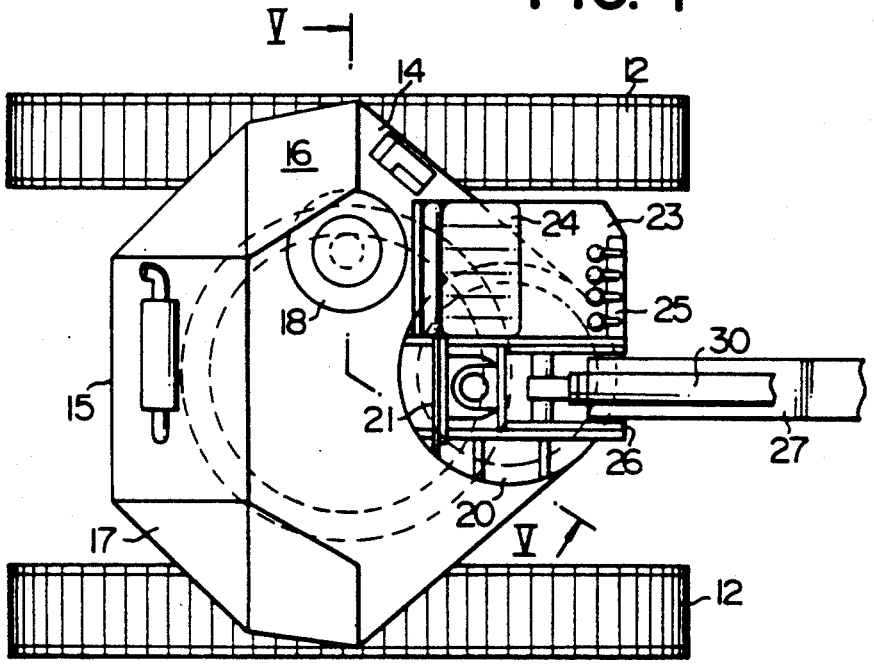
FIG. 4 is a plan view of the excavator of FIG. 1.

As shown in FIGS. 1 through 5, the excavator is of the self-propelled type having a flat mobile chassis 10 supporting four wheels 11 with an endless track 12 trained around each pair of wheels 11. The mobile chassis 10 includes a central support base 13 (FIGS. 2, 3 and 5) mounted thereon and having an upper annular flange on which a horizontal turntable 14 of an octagonal configuration is rotatably mounted. As better shown in FIG. 4, the turntable 14 supports thereon an engine 15, a fuel tank 16, and a hydraulic oil tank 17 arranged along a rear edge of the turntable 14. A first hydraulic motor 18 is also mounted on the turntable 14 adjacent to the fuel tank 16 and has a drive shaft 37 (FIG. 5) directed downwardly of the turntable 14. As illustrated in FIGS. 2 and 3, an annular horizontal holder base 19 is fixedly mounted on the turntable 14 at a front edge thereof. The annular holder case 19 has an axis held in horizontally eccentric and parallel relation to the axis of the support base 13 and hence the turntable 14. A circular carriage 20 is rotatably mounted coaxially on the holder base 19.

Figure 5:
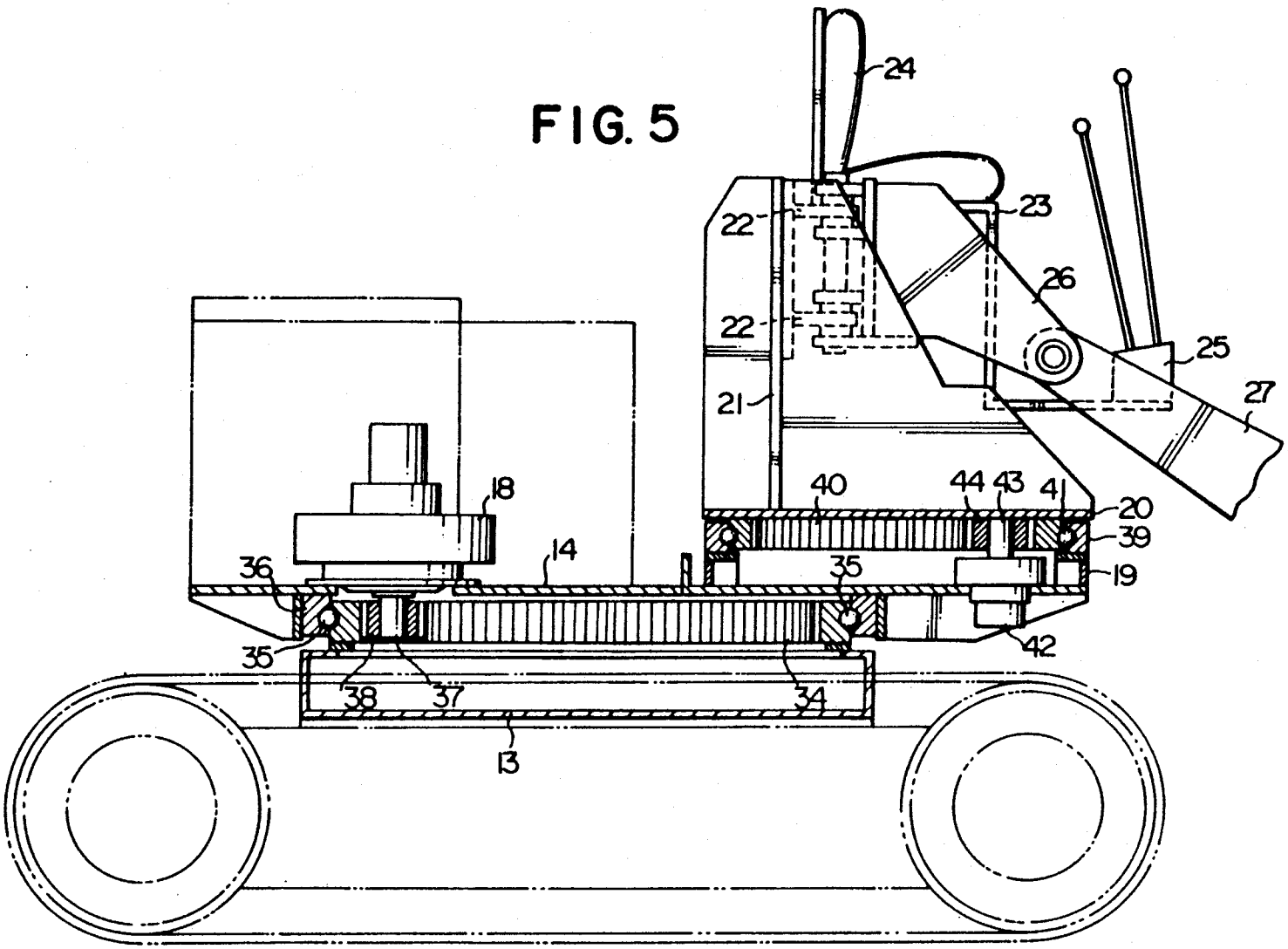
FIG. 5 is an enlarged cross-sectional view taken line V—V of FIG. 4.

As shown in FIGS. 3 and 5, the carriage 20 includes a vertical support 21 to which a pair of vertically spaced legs 22 is secured. A bracket 26 is pivotably mounted on the legs 22 and supports thereon a bent boom 27 which is vertically angularly movable about a pivot on the bracket 26. The boom 27 supports on its distal end a bucket arm 28 having a bucket 29 pivotably mounted on a distal end of the bucket arm 28. Hydraulic cylinders 30, 31, 32 are coupled respectively between the bracket 26 and a central portion of the boom 27, between a central portion of the boom 27 and an end of the bucket arm 28, and between the bucket arm 28 and the bucket 29. The boom 27, the bucket arm 28, the bucket 29, and the hydraulic cylinders 30, 31, 32 jointly constitute an excavating mechanism 33. The bracket 26 also supports a seat base 23 on which there are mounted an operator seat 24 and a hydraulic control box 25 supporting a plurality of pivotable control levers.

Figure 6:
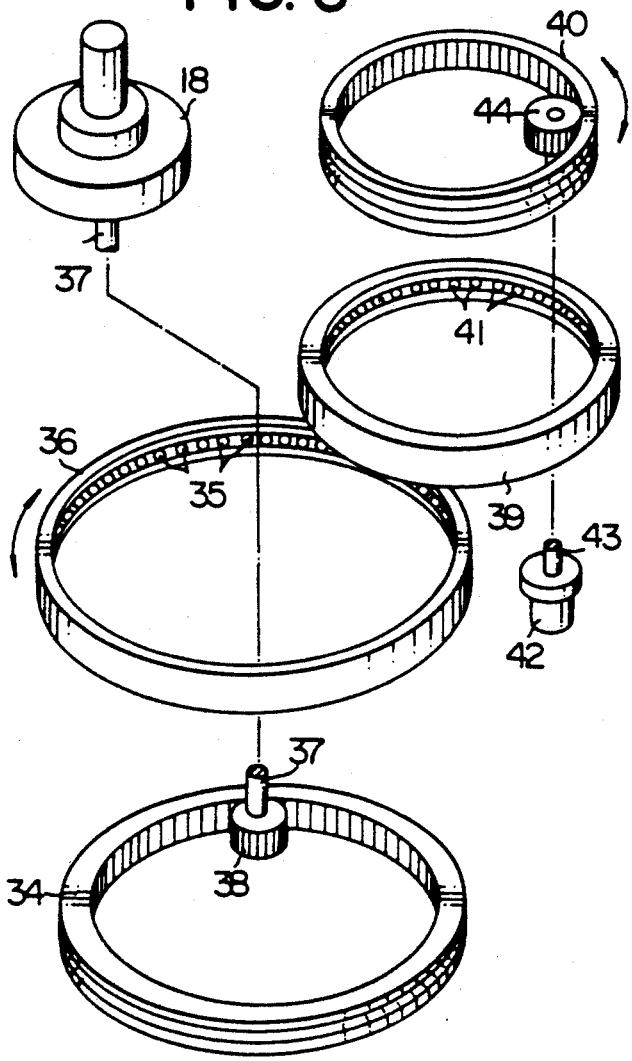
FIG. 6 is an exploded perspective view of a turning mechanism on the excavator shown in FIG. 1.
Figure 7:
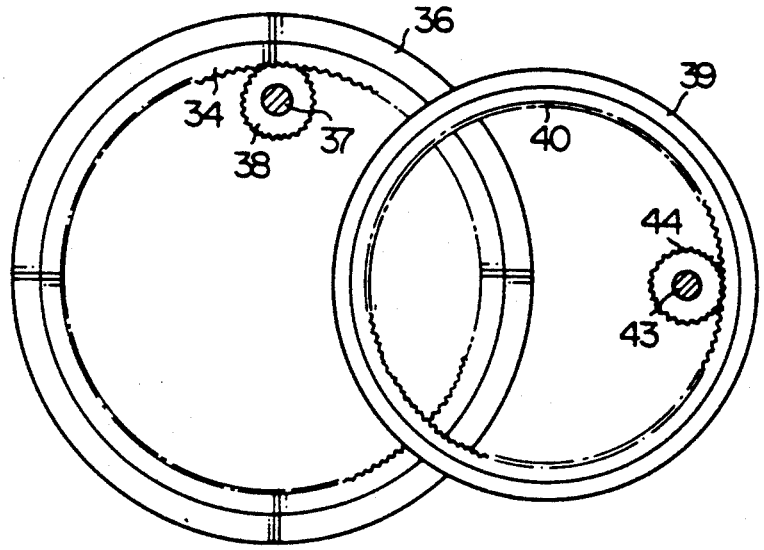
FIG. 7 is a plan view of the turning mechanism, as assembled, of FIG. 6.

As illustrated in FIGS. 5, 6 and 7, the excavator includes a mechanism for turning the turntable 14 and the carriage 20, the mechanism having a first annular internal gear 34 fixedly mounted substantially concentrically on the annular flange of the support base 13. The turntable 14 has a slider ring 36 disposed securely therebelow and rotatably fitted over the internal gear 34 with ball bearings 35 rotatably interposed therebetween. Accordingly, the turntable 14 is rotatable coaxially on the first internal gear 34. A pinion 38 is fixed to the drive shaft 37 of the hydraulic motor 18 and held in driving mesh with the internal gear 34. The holder base 19 supports thereon an annular holder 39 affixed coaxially thereto. The carriage 20 has a second annular internal gear 40 fixed to the underside thereof and rotatably fitted in the annular holder 39 with ball bearings 41 rotatably interposed therebetween. Therefore, the carriage 20 is rotatable coaxially with the annular holder 39. A second hydraulic motor 42 is mounted on the turntable 14 and located at a front end portion thereof within the holder base 19, and has an upwardly extending drive shaft 43 on which there is mounted a pinion 44 held in driving mesh with the second internal gear 40.

Figure 8:
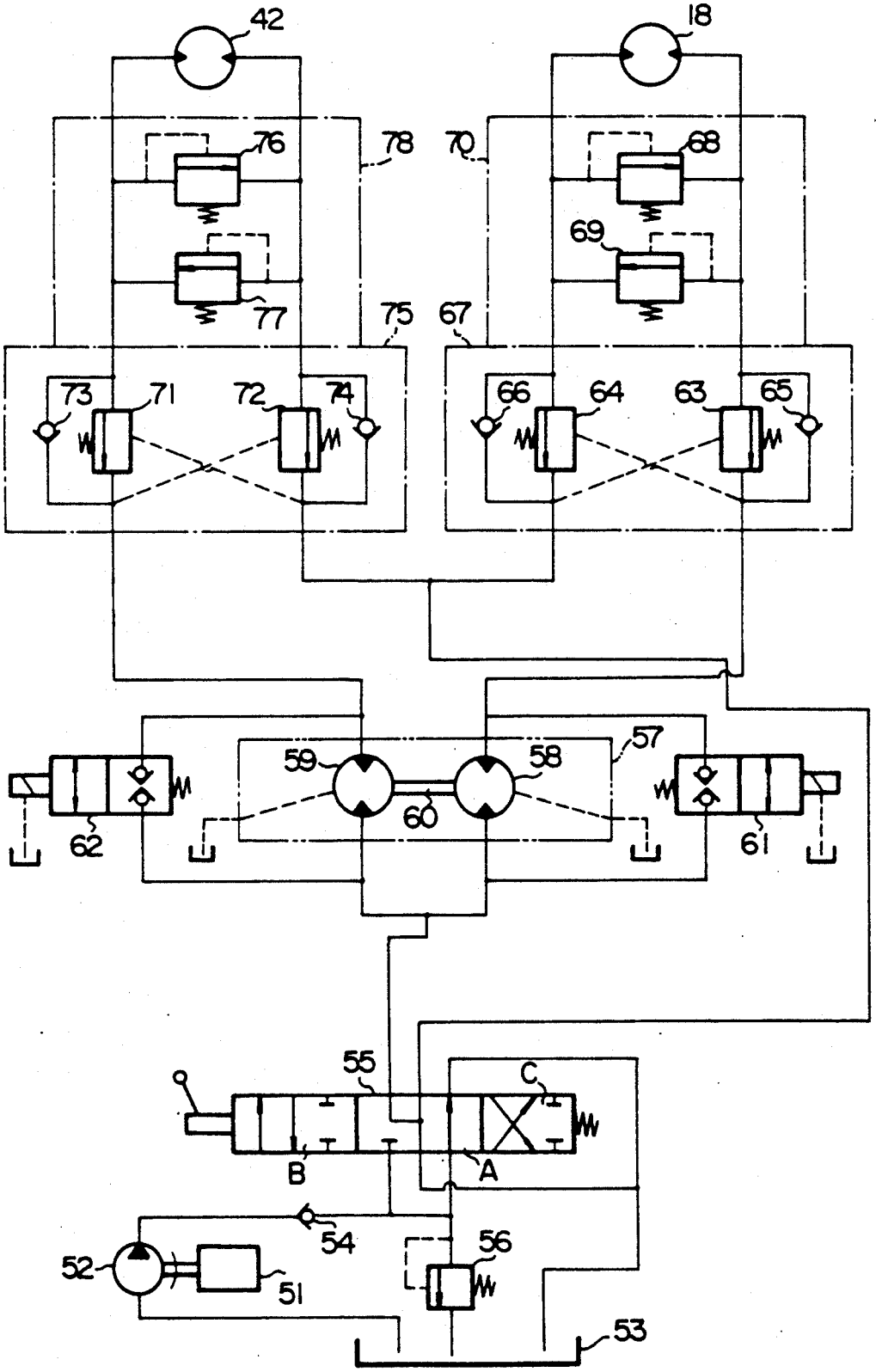
FIG. 8 is a circuit diagram of a hydraulic control system for controlling the turning mechanism of FIG. 6.

FIG. 8 shows a hydraulic control system for controlling the operation of the turning mechanism shown in FIGS. 5 through 7. The hydraulic control system includes a hydraulic pump 52 driven by an engine 51. The hydraulic pump 52 has a suction port connected to a tank 53 of a working fluid or oil and a discharge port connected through a check valve 54 to a manually operable directional control valve 55 and a relief valve 56 having a port communicating with the tank 53. The directional control valve 55 can be shifted between three selectable positions and has three blocks, namely, a neutral block A, a normal rotation block B, and a reverse rotation block C. A fluid rate synchronizer 57 is composed of a pair of synchronizer motors (hydraulic motors) 58, 59 interconnected by a shaft 60 and communicating with a first outlet port of the directional control valve 55. The synchronizer motors 58, 59 rotate in synchronism with each other for discharging amounts of fluid at a desired accurate ratio at all times. The synchronizer motors 58, 59 have displacement volumes which are selected to be at a ratio of 1 : 2, respectively. The synchronizer motor 58 has inlet and outlet ports coupled to a normally-closed solenoid-operated valve 61, while the synchronizer motor 59 has inlet and outlet ports coupled to a normally-closed solenoid-operated valve 62. The synchronizer motor 58 is connected to a normally-closed loading valve 63 connected in series to the hydraulic motor 18 for imposing a load or back pressure on the hydraulic motor 18 and another normally-closed loading valve 64 which is coupled to a second outlet port of the directional control valve 55. The normally-closed loading valves 63, 64 can be opened alternatively by fluid inputs applied in opposite directions to the hydraulic motor 18. The loading valves 63, 64 are shunted respectively by check valves 65, 66. The loading valves 63, 64 and the check valves 65, 66 thus jointly constitute a counterbalancing valve assembly 67. The hydraulic motor 18 is shunted by a pair of parallel relief valves 68, 69 directed in opposite directions and jointly constituting a brake 70. Likewise, the synchronizer motor 59 is connected to a normally-closed loading valve 71 connected in series to the hydraulic motor 42 for imposing a load or back pressure on the hydraulic motor 59 and another normally-closed loading valve 72 which is coupled to the second outlet port of the directional control valve 55. The normally-closed loading valves 71, 72 can be opened alternatively by fluid inputs applied in opposite directions to the hydraulic motor 42. The loading valves 71, 72 are shunted respectively by check valves 73, 74. The loading valves 71, 72 and the check valves 73, 74 thus jointly constitute a counterbalancing valve assembly 75. The hydraulic motor 42 is shunted by a pair of parallel relief valves 76, 77 directed in opposite directions and jointly constituting a brake circuit 78. The hydraulic motors 18, 42 have displacement volumes which are equal to each other or at a ratio of 1 : 1.

Operation of the excavator thus constructed will now be described.

The operator sitting on the operator seat 24 operates on the control box 25 to actuate the hydraulic cylinders 30, 31, 32 for thereby moving the bucket 29 upwardly and downwardly to dig a trench in the well known manner. The material scooped up by the bucket 29 can be transferred to a truck or the like behind the excavator by lifting the bucket 29 to a horizontal position, as shown in FIG. 3, with the lower end of the bucket 29 slightly above the parts on the turntable 14 and then turning the bucket 29 rearwardly of the chassis 10.

Turning of the turntable 14 and the carriage 20 by the hydraulic motors 18, 42 will be described with respect to three modes of operation:

(1) Synchronous Rotation of the Turntable 14 and the Carriage 20

The solenoid-operated valves 61, 62 are inactivated to provide the synchronizer motors 58, 59 with no bypass passages, and the directional control valve 55 is shifted to put the normal-rotation block B in operative position. Oil under pressure discharged from the hydraulic pump 52 is supplied through the directional control valve 55 to the synchronizer motors 58, 59 which rotate in synchronism to discharge oil under pressure at rates having the ratio of 1 : 2. The oil under pressure from the synchronizer motor 58 goes through the check valve 65 to the hydraulic motor 18. The oil under pressure having passed through the hydraulic motor 18 is delivered through the two-way valve 64 and the directional control valve 55 back to the tank 53. The oil under pressure from the synchronizer motor 59 is delivered through the check valve 73, the hydraulic motor 42, the two-way valve 72, and the directional control valve 55 back to the tank 53. Since the amount of oil discharged by the synchronizer motor 59 is twice that of oil discharged by the synchronizer motor 58, and the hydraulic motors 18, 42 have the same displacement volume, the hydraulic motor 42 is rotated at a speed which is twice that of rotation of the hydraulic motor 18. When the hydraulic motor 18 is thus rotated, the output shaft 37 the pinion 38 of the hydraulic motor 18 are rotated to enable the slider ring 36 to turn along the internal gear 34, whereupon the turntable 14 is angularly moved with respect to the chassis 10. When the hydraulic motor 42 is simultaneously rotated, the output shaft 43 and the pinion 44 of the hydraulic motor 42 are rotated to enable the the internal gear 40 to rotate along the annular holder 39. Therefore, the carriage 20 mounted on the internal gear 40, the support 21, and the excavating mechanism 33 are rotated with respect to the turntable 14. The hydraulic motors 18, 42 are arranged such that they rotate in opposite directions. Therefore, the turntable 14 and the carriage 20 rotate in opposite directions, allowing the excavating mechanism 33 on the carriage 20 to pass over the turntable 14.

Figure 9A:
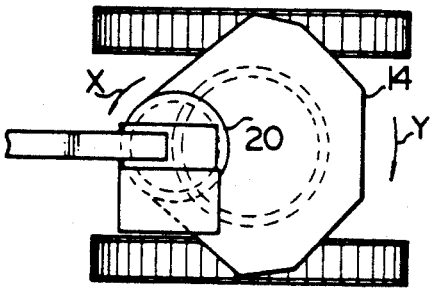
FIGS. 9A through 9C are plan views showing successive angular positions of a turntable and a carriage, as they are in synchronism, of the excavator shown in FIG. 1.
Figure 9B:
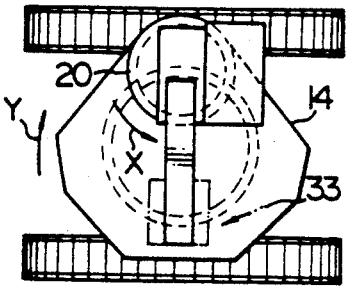
Figure 9C:
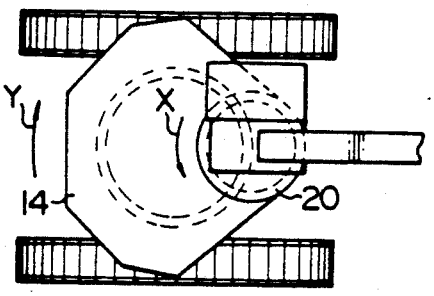

The relative angular displacement of the turntable 14 and the carriage 20 rotated by the hydraulic motors 18, 42 will be described with reference to FIGS. 9A through 9C. The carriage 20 starts to be rotated by the hydraulic motor 42 in the direction of the arrow X, and the turntable 14 starts to be rotated by the hydraulic motor 18 in the direction of the arrow Y (FIG. 9A). As described above, the carriage 20 and the turntable 14 are controlled to turn at an angular displacement ratio of 1 : 2. Therefore, the carriage 20 rotates at a speed twice higher than the speed of rotation of the turntable 14. When the turntable 14 rotates through 90 degrees, the carriage 20 rotates through 180 degrees. Since the turntable 14 and the carriage 20 rotate in the opposite directions, they relatively rotate through 90 degrees. The excavating mechanism 33 is positioned at a right angle to the longitudinal axis of the chassis 10 as shown in FIG. 9B. At this time, the carriage 20 is displaced on one side of the chassis 10 to a maximum extent, with the excavating mechanism 33 moving over the turntable 14 without projecting sideways from the other side of the chassis 10. When the turntable 14 is further rotated through another 90 degrees, the carriage 20 rotates through 180 degrees for a total of 360° to the opposite end of the chassis 10, at which time the excavating mechanism 33 projects from the end of the chassis 10 in a position shown in FIG. 9C which is 180 degrees inverted from the position of FIG. 9A. When the turntable 14 and the carriage 20 reach the position of FIG. 9C, the directional control valve 55 is returned to its neutral position A to stop the operation of the hydraulic motors 18, 42 thus stopping the rotation of the turntable 14 and the carriage 20. Accordingly, the excavating mechanism 33 is turned on the basis of the turning movement of the turntable 14 on the chassis 10 and the opposite turning movement of the carriage 20 on the turntable 14, so that the excavating mechanism 33 will move from a forward position to a rearward position across and over the turntable 14 while rotating in a range in which the excavating mechanism 33 will not project laterally of the chassis 10. When it is necessary to turn the excavating mechanism 33 back from the position of FIG. 9C to the position of FIG. 9A, the directional control valve 55 is shifted to select the reverse-rotation block C to cause the turntable 14 to turn 180 degrees and the carriage 20 to rotate at a certain ratio to the rotation of the turntable 14 in the foregoing manner. The turntable 14 and the carriage 20 are now caused to turn at the predetermined ratio back to the starting position.

(2) Rotation of the Turntable 14 Only

Figure 10:
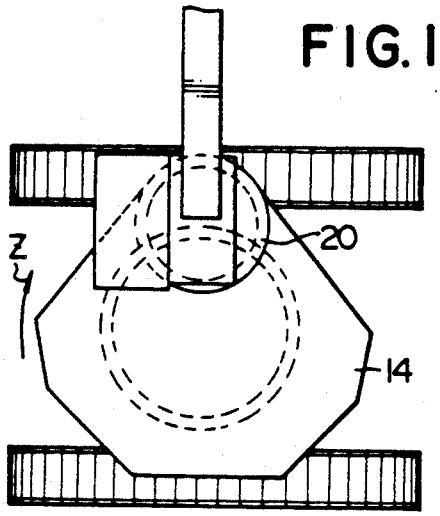
FIG. 10 is a plan view of the excavator of FIG. 1, showing the turntable as angularly moved with respect to a chassis.

The solenoid-operated valve 61 is actuated to provide a bypass passage across the synchronizer motor 58. The directional control valve 55 is shifted to select the normal-rotation block B. Oil under pressure from the hydraulic pump 52 is supplied to the synchronizer motors 58, 59. Since there is the bypass passage through the solenoid-operated valve 61, the oil flows through the bypass passage of smaller friction, and the synchronizer motors 58, 59 are not rotated. Only the hydraulic motor 18 is supplied with the oil under pressure, and is operated. The output shaft 37 and the pinion 38 are rotated to rotate the slider ring 36 along the internal gear 34. Therefore, only the turntable 14 is turned in the direction of the arrow Z (FIG. 10) with respect to the chassis 10. As the turntable 14 is thus turned, the carriage 20 and the excavating mechanism 33 project laterally of the chassis 10 as shown in FIG. 10. The excavating mechanism 33 can now be moved up and down to effect digging operation in a position laterally of the chassis 10.

(3) Rotation of the Carriage 20 Only

Figure 11:
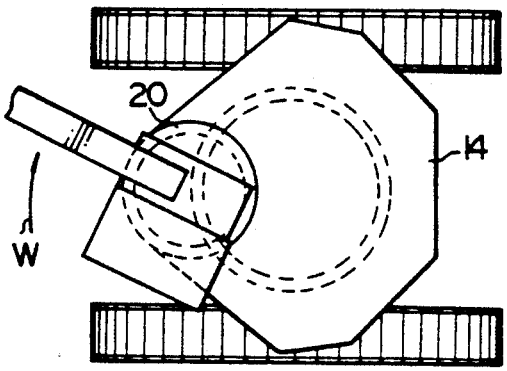
FIG. 11 is a plan view of the excavator of FIG. 1, showing the carriage as angularly moved with respect to the turntable.

The solenoid-operated valve 62 is actuated to provide a bypass passage across the synchronizer motor 59. The directional control valve 55 is shifted to select the normal-rotation block B. Oil under pressure from the hydraulic pump 52 is supplied through the bypass passage to only the hydraulic motor 42. Therefore, the output shaft and the pinion 44 are rotated to turn the internal gear 40 along the annular holder 39. The carriage 20 on the internal gear 40, the support 21, and the excavating mechanism 33 on the carriage 20 are now turned in the direction of the arrow W (FIG. 11) with respect to the turntable 14. Since the hydraulic motor 18 is not in operation, the turntable 14 retains at rest. Therefore, the excavating mechanism 33 is angularly moved through the angular interval through which the carriage 20 is turned with respect to the turntable 14, as shown in FIG. 11. In the position of FIG. 11, only the carriage 20 is angularly moved to enable the excavating mechanism 33 to swing in a sectorial zone in front of the chassis 10, so that the road can be dug by the excavating mechanism in such a sectorial zone.

The speed of rotation of the hydraulic motor 42 may be kept twice that of rotation of the hydraulic motor 18 by selecting the ratio of displacement volumes of the synchronizer motors 58, 59 to be 1 : 1 and also selecting the ratio of displacement volumes of the hydraulic motors 8, 42 to be 2 : 1.

Figure 12:
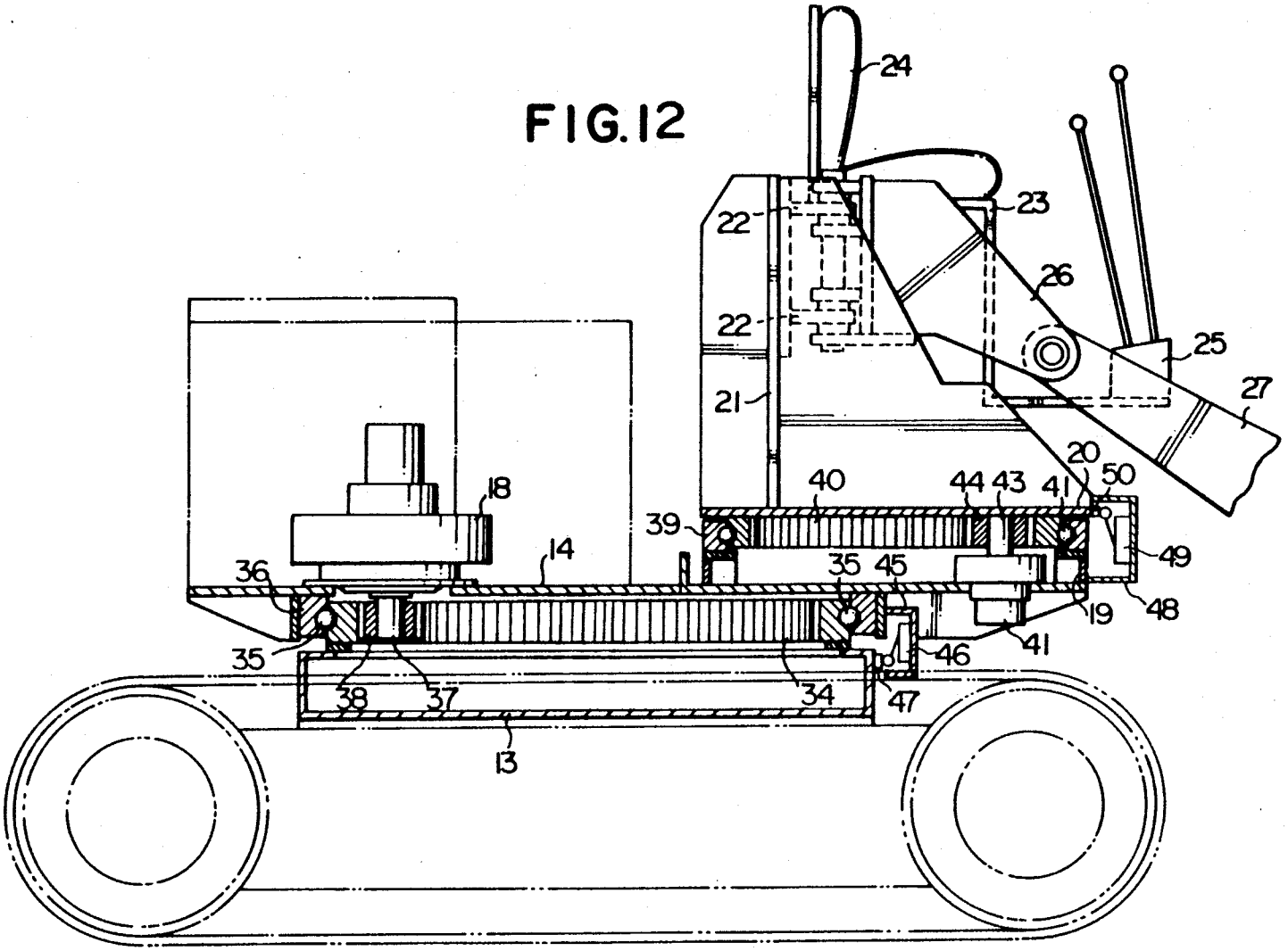
FIG. 12 is a side elevational view of an excavator according to another embodiment of the present invention.

FIGS. 12 through 16 show an excavator according to another embodiment. As shown in FIG. 12, a first position detector 45 is mounted on the lower side of the turntable 14 at its front portion thereof. The first position detector 45 is composed of a first limit switch 46 which can be actuated by a first contacting member 47 mounted on the chassis 13 and projecting in a forward direction thereof (see also FIGS. 13 and 14). A second position detector 48 is mounted on the front side of the annular holder 19 and comprises a second limit switch 49 which can be actuated by a second contact member 50 mounted on the front side of the carriage 20 and projecting in a forward direction thereof (see also FIGS. 13 and 14).

Figure 13:
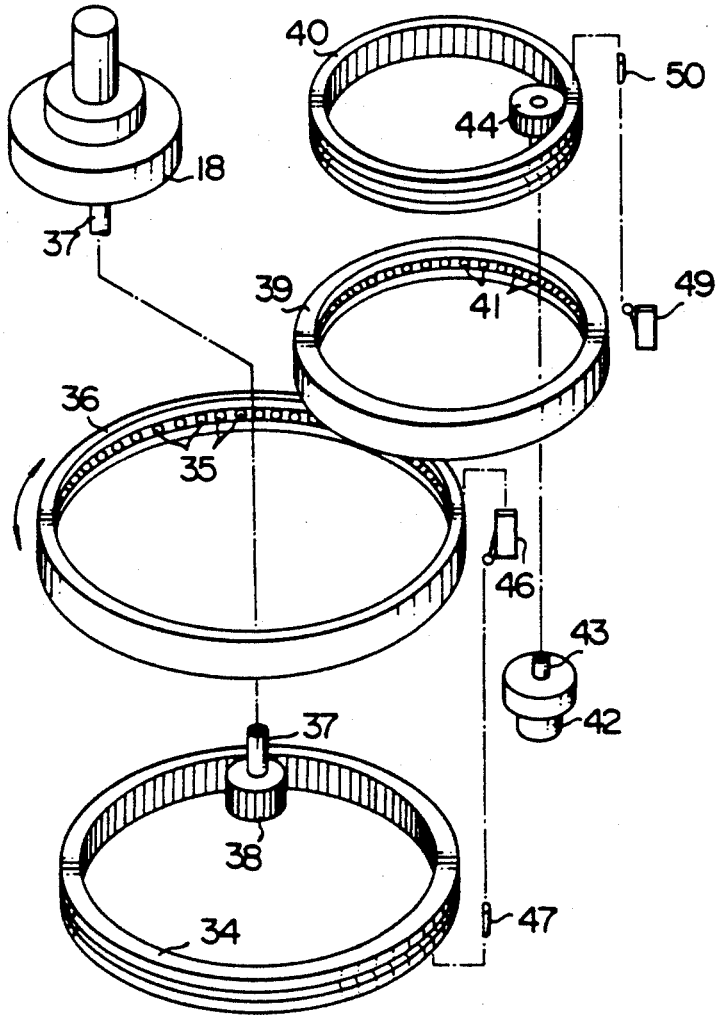
FIG. 13 is an exploded perspective view of a turning mechanism on the excavator shown in FIG. 12.
Figure 14:
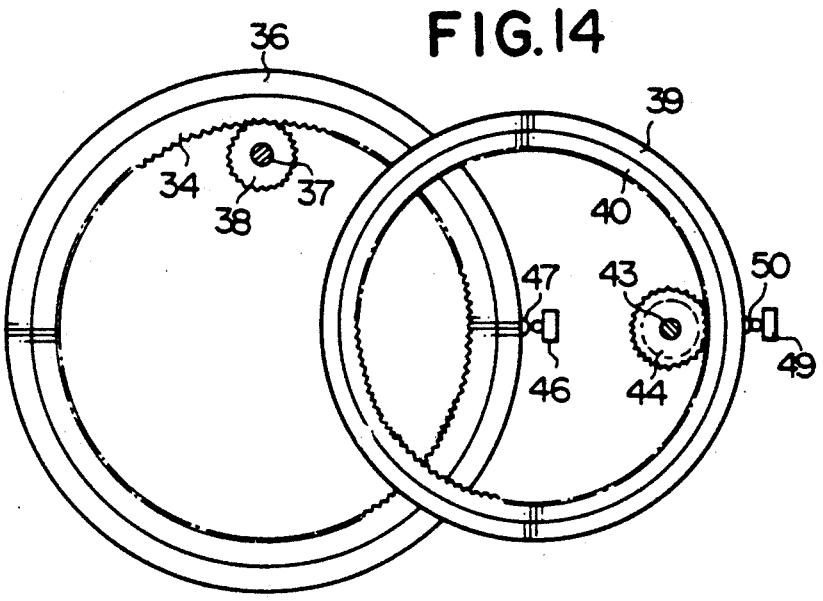
FIG. 14 is a plan view of the turning mechanism, as assembled, of FIG. 13.
Figure 15:
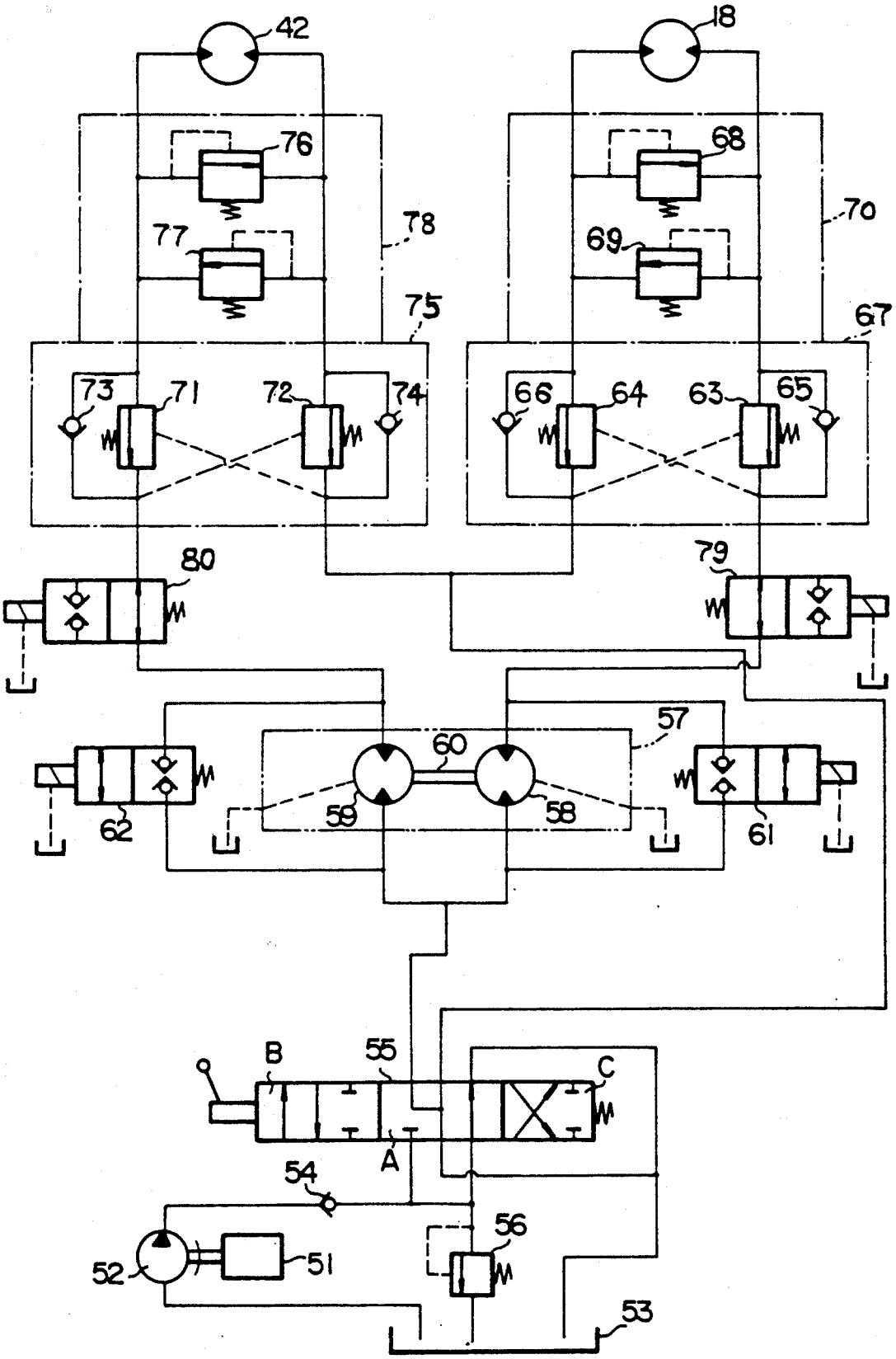
FIG. 15 is a circuit diagram of a hydraulic control system for controlling the turning mechanism of FIG. 13.

FIG. 15 shows a hydraulic control system for the turning mechanism shown in FIGS. 12 through 14. The hydraulic control system of FIG. 15 is similar to that shown in FIG. 8 except that normally open solenoid-operated valves 79, 80 are connected between the synchronizer motor 58 and the loading valve 63 and between the synchronizer motor 59 and the loading valve 71, respectively.

Figure 16:
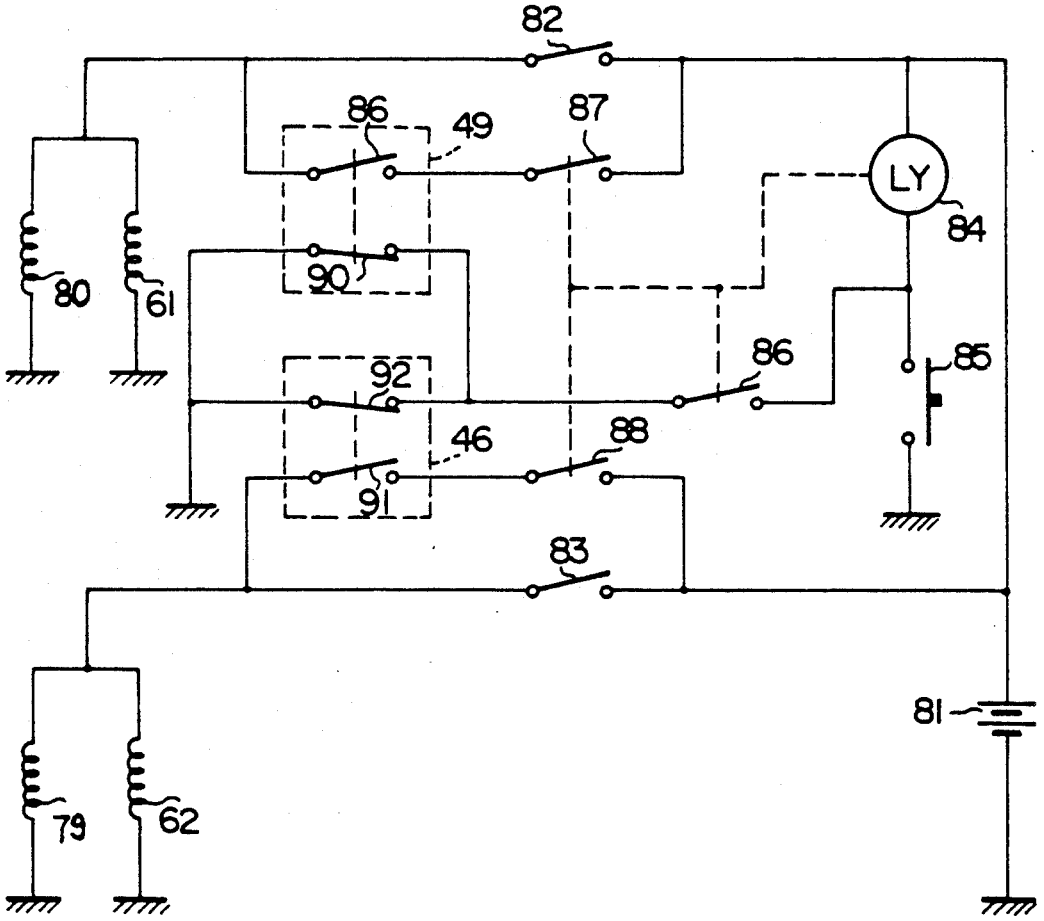
FIG. 16 is a circuit diagram of an electric control circuit for controlling the hydraulic control system shown in FIG. 15.

FIG. 16 illustrates an electric control circuit for controlling the hydraulic control system shown in FIG. 15. The electric control circuit includes a battery 81 coupled to parallel manually operable switches 82, 83. The switch 82 is connected to the solenoid-operated valves 61, 80 which are coupled parallel to each other, and the switch 83 is connected to the solenoid-operated valves 62, 79 which are coupled parallel to each other. The battery 81 is also connected in series to a relay 84 and a correction switch 85. The relay 84 can actuate normally open switches 86, 87, 88. The switch 86 is connected to a junction between the relay 84 and the correction switch 85. The switches 87, 88 are connected parallel to the switches 82, 83, respectively. The limit switch 49 has a normally open switch 89 and a normally closed switch 90 which are ganged together, while the limit switch 46 has a normally open switch 91 and a normally closed switch 92 which are ganged together. The normally open switch 89 is connected in series to the switch 87 in parallel relation to the switch 82, and the normally open switch 91 is connected in series to the switch 88 in parallel relation to the switch 83. The switch 86 is also connected to the junction between the normally closed switches 90, 92 which are connected parallel to each other and to ground.

Operation of the excavator shown in FIGS. 12 through 16 will be described primarily with respect to those components which have been added in the embodiment of FIGS. 12 through 16.

(1a) Synchronous Rotation of the Turntable 14 and the Carriage 20

The switches 82, 83 are kept open to leave the solenoid-operated valves 61, 62, 79, 80 de-energized. Therefore, no bypass passage is formed across the synchronizer motors 58, 59. The directional control valve 55 is shifted to select the normal-rotation block B for operation.

Oil under pressure flows from the synchronizer motor 58 through the solenoid-operated valve 79 to the hydraulic motor 18, and also flows from the synchronizer motor 59 through the solenoid-operated valve 80 to the hydraulic motor 42. Therefore, the turntable 14 and the carriage 20 operate in the same manner as in the mode (1) described above.

(2a) Rotation of the Turntable 14 Only

The switch 82 is manually closed to actuate the solenoid-operated valves 61, 80. A bypass passage is formed across the synchronizer motor 58, and the solenoid-operated valve 80 is closed. When the directional control valve 55 is shifted to select the normal-rotation block B, oil from the hydraulic pump 52 flows only to the hydraulic motor 18 through the solenoid-operated valves 61, 79. The turntable 14 operates in the same manner as in the previous mode (2).

(3a) Rotation of the Carriage 20 Only

The switch 83 is manually closed to actuate the solenoid-operated valves 62, 79. A bypass passage is formed across the synchronizer motor 59, and the solenoid-operated valve 79 is closed. When the directional control valve 55 is shifted to select the normal-rotation block B, oil from the hydraulic pump 52 flows only to the hydraulic motor 42 through the solenoid-operated valves 62, 80. The carriage 20 operates in the same manner as in the previous mode (3).

(4) Correction of Asynchronous Angular Positions of the

Turntable 14 and the Carriage 20

When the turntable 14 and the carriage 20 are subjected to a relative angular positional error or after they have been turned independently of each other, it is necessary to correct their angular positions for synchronous operation.

For such correction, the switches 82, 83 are kept open and the correction switch 85 is closed. The relay 84 is energized to close the switches 86, 87, 88. When the switch 86 is closed, the relay 84 is held actuated and a current flows from the relay 84 through the switches 90, 92. The directional control valve 55 is shifted to select the normal-rotation block B of the reverse-rotation block C, whereupon the turntable 14 and the carriage 20 start rotating. When the turntable 14 is turned through a certain angular interval until its front end coincides with the front end of the chassis 10, the limit switch 46 is engaged by the contacting member 47. The switch 91 is now closed and the switch 92 is opened. The solenoid-operated valves 62, 79 are now energized through the switches 88, 91 to stop the supply of oil to the hydraulic motor 18, whereupon the turntable 14 is stopped. When the carriage 20 is turned until its front end coincides with the front end of the turntable 14, the limit switch 49 is engaged by the contacting member 50. The switch 89 is now closed and the switch 90 is opened. The solenoid-operated valves 61, 80 are now energized through the switches 87, 89 to stop the supply of oil to the hydraulic motor 42, whereupon the carriage 20 is stopped. When the switches 90, 92 are opened, no current flows through the relay 84 causing the switches 86, 87, 88 to be opened, and the relay 84 is released. The turntable 14 and the carriage 20 are then brought into synchronized angular positions for starting synchronous operation thereof.

Although certain preferred embodiments have been shown and described, it should be understood that many changes and modifications may be made therein without departing from the scope of the appended claims.

What is claimed is:

1. An earth-working machine comprising:

a mobile chassis;

a turntable mounted centrally on said chassis and rotatable 360° on said mobile chassis, an axis of said turntable being in coaxial relation to an axis of said mobile chassis;

a carriage mounted on said turntable and rotatable 360° on said turntable, an axis of said carriage being in horizontally eccentric relation to said axis of said turntable;

an earth-working mechanism mounted on said carriage;

a first driving means for rotating said turntable horizontally about said chassis, and a second driving means for rotating said carriage horizontally about said turntable;

a fluid pressure generating source;

a synchronizer composed of a pair of synchronizing means, one of said pair of said synchronizing means being interposed respectively between said fluid pressure generating source and one of said first and second driving means, for allowing a fluid under pressure to be applied to said first and second driving means at a constant ratio of 1:2;

a synchronize release means for providing an independent rotation of each of said first and second driving means and for allowing an amount of fluid to pass through said synchronize release means to a low pressure, said fluid being supplied selectively to each of said first and second driving means at a constant ratio, said synchronize release means comprises first and second normally closed solenoid valves and said one pair of synchronizing means interconnected by a common output shaft for discharging an amount of fluid under pressure at said constant ratio, said fluid pressure generating source being coupled to said one pair of synchronizing means, said first and second driving means being coupled to said one pair of synchronizing means, respectively, and said first and second normally closed solenoid-operated valves being connected across said one pair of synchronizing means, respectively, for providing a plurality of bypass passage ways across said one pair of synchronizing means when said first and second normally closed solenoid valves are actuated;

whereby said turntable and said carriage are independently rotated with respect to each other such that said turntable is rotatable while said carriage is stopped and said carriage is rotated while said turntable is stopped.

2. An earth-working machine according to claim 1, wherein said first and second driving means comprise first and second fluid control motors, and further wherein said one pair of synchronizing means comprise third and fourth fluid control motors.

3. An earth-working machine according to claim 2, wherein said synchronous release means includes first and second normally open solenoid-operated valves which are connected to cooperate with said first and second normally closed solenoid-operated valves and further connected across said third and fourth fluid control motors to provide a plurality of bypass passages.

4. An earth-working machine according to claim 3, wherein said first normally opened solenoid-operated valve is connected to operate with said first fluid control motor and said third fluid control motor and said second normally opened solenoid-operated valve is connected to operate with said second fluid control motor and fourth fluid control motor.

5. An earth-working machine according to claim 4, further including an electrical control circuit having a first switch for simultaneously actuating said first normally closed solenoid-operated valve and said second normally open solenoid-operated valve, and having a second switch for simultaneously actuating said second normally closed solenoid-operated valve and said first normally open solenoid-operated valve.

6. An earth-working machine according to claim 5, wherein said control circuit includes a first position detector for detecting a first angular position of said turntable with respect to said mobile chassis, and a second position detector for detecting a second angular position of said carriage with respect to said turntable.

7. An earth-working machine according to claim 6, wherein said first position detector includes a third switch connected parallel to said first switch for simultaneously actuating said first normally closed solenoid-operated valve and said second normally open solenoid-operated valve when said first angular position is detected, and said second position detector including a fourth switch connected parallel to said second switch for simultaneously actuating said second normally closed solenoid-operated valve and said first normally open solenoid-operated valve when said second angular position is detected.

8. An earth-working machine comprising:

a mobile chassis;

a turntable mounted centrally on the mobile chassis and rotatable substantially in all directions on the mobile chassis, an axis of the turntable being in coaxial relation to an axis of the mobile chassis;

a carriage mounted on the turntable and rotatable 360° on the turntable, an axis of the carriage being in horizontally eccentric relation to the axis of the turntable;

an earth-working mechanism mounted on the carriage;

a first driving means for rotating the turntable horizontally about the chassis, and as second driving means operable independent from the fist driving means for rotating the carriage about the turntable horizontally;

a fluid pressure generating source;

a fluid amount synchronous means, the fluid amount synchronous means comprising a pair of fluid supply means coupled by a synchronous shaft for supplying the same amount of fluid under pressure from the inputs thereof to the outputs thereof in proportion to the rotary angle of the synchronous shaft;

a fluid bypass circuit being interposed between the inputs and the outputs of the fluid supply means for connecting across each fluid supply means so as to bypass each fluid supply means, the fluid bypass circuit comprising normally closed solenoid valves;

an electric control circuit for actuating one of the solenoid valves when synchronous operation between the turntable and the carriage is released to thereby rotate one of the turntable or the carriage;

characterized in that the same amount of fluid under pressure is normally supplied from the fluid pressure generating source to the first and the second driving means by the fluid supply means thereby allowing the rotary angle of the turntable to be synchronous with the rotary angle of the carriage;

or fluid under pressure is supplied from the fluid pressure generating source to only the first driving means or only the second driving means by allowing the fluid bypass circuit to be opened by opening one of the normally closed solenoid valves.

9. An earth-working machine according to claim 8, wherein said pair of fluid supply means is driven by a fluid under pressure, said fluid being supplied from said fluid pressure generating source, said pair of fluid supply means being via said synchronous shaft interconnected by said synchronous shaft which is a common output shaft for supplying said fluid at a constant ratio, and said pair of fluid supply means being interposed between said fluid pressure generating source and said first and second driving means.

10. An earth-working machine comprising:

a mobile chassis;

a turntable mounted centrally on said chassis and rotatable 360° on said mobile chassis, an axis of said turntable being in coaxial relation to an axis of said mobile chassis;

a carriage mounted on said turntable and rotatable 360° on said turntable, an axis of said carriage being in horizontally eccentric relation to said axis of said turntable;

an earth-working mechanism mounted on said carriage;

a first driving means for rotating said turntable horizontally about said chassis and a second driving means for rotating said carriage horizontally about said turntable;

a fluid pressure generating source;

a synchronizer composed of a pair of synchronizing means, one of said pair of said synchronizing means being interposed respectively between said fluid pressure generating source and one of said first and second driving means, for allowing a fluid under pressure to be supplied to said first and second driving means at a constant ratio of 1:2;

a synchronize release means for providing an independent rotation of each of said first and second driving means and for allowing an amount of fluid to pass through said synchronize release means at a low pressure, said fluid being supplied selectively to each of said first and second driving means at said constant ratio, said synchronous release means comprising first and second normally closed solenoid valves and first and second normally open solenoid valves, one of said first and second closed solenoid valves being respectively provided in parallel to one of sad pair of first pair of synchronizing means and one of said first and second normally open solenoid valves being respectively interposed between one of said first pair of synchronizing means and said first and second driving means for allowing said fluid under pressure to be selectively supplied to said first and second driving means at said constant ratio for simultaneously rotating both the turn table and the carriage and a means for selectively operating said first and second normally closed solenoid valves and said first and second normally opened valves;

whereby said turntable is rotated while said carriage is stopped or said carriage is rotated while said turntable is stopped.

11. An earth-working machine comprising:

a mobile chassis;

a turntable mounted centrally on the mobile chassis and rotatable substantially in all directions on the mobile chassis, an axis of the turntable being in coaxial relation to an axis of the mobile chassis;

a carriage mounted on the turntable and rotatable 360° on the turntable, an axis of the carriage being in horizontally eccentric relation to the axis of the turntable;

an earth-working mechanism mounted on the carriage;

a first driving means for rotating the turntable horizontally about the chassis, and a second driving means operable independent from the first driving means for rotating the carriage about the turntable horizontally;

a fluid pressure generating source;

a fluid amount synchronous means, the fluid amount synchronous means comprising a pair of fluid supply means coupled by a synchronous shaft for supplying the same amount of fluid under pressure from the inputs thereof to the output thereof in proportion to the rotary angle of the synchronous shaft;

a fluid bypass circuit being interposed between the inputs and the outputs of the fluid supply means for connecting across each fluid supply means so as to bypass each fluid supply means, the fluid bypass circuit comprising normally closed solenoid valves;

an electric control circuit for actuating one of the solenoid valves when synchronous operation between the turntable and the carriage is released to thereby rotate one of the turntable or the carriage;

a first counter balance mechanism comprising a first check valve and a first loading valve disposed in parallel with each other and interposed between the first driving means and the fluid supply means and a second check valve and a second loading valve disposed in parallel with each other and interposed between the first driving means and a directional control valve;

a second counter balance mechanism comprising a first check valve and a first loading valve disposed in parallel with each other and interposed between the second driving means and the fluid supply means and a second check valve and a second loading valve disposed in parallel with each other and interposed between the second driving means and the direction control valve;

characterized in that the same amount of fluid under pressure is normally supplied from the fluid pressure generating source to the first and the second driving means by the fluid supply means thereby allowing the rotary angle of the turntable to be synchronous with the rotary angle of the carriage;

or fluid under pressure is supplied from the fluid pressure generating source to only the first driving means or only the second driving means by allowing the fluid bypass circuit to be opened by opening one of the normally closed solenoid valves;

and fluid under pressure is prevented from flowing out from the first driving means and the second driving means when both of the solenoid valves are not actuated.

12. An earth-working machine comprising:

a mobile chassis;

a turntable mounted centrally on the mobile chassis and rotatable substantially in all directions on the mobile chassis, an axis of the turntable being in coaxial relation to an axis of the mobile chassis;

a carriage mounted on the turntable and rotatable 360° on the turntable, an axis of the carriage being in horizontally eccentric relation to the axis of the turntable;

an earth-working mechanism mounted on the carriage;

a first driving means for rotating the turntable horizontally about the chassis, and a second driving means operable independent from the first driving means for rotating the carriage about the turntable horizontally;

a fluid pressure generating source;

a fluid amount synchronous means, the fluid amount synchronous means comprising a pair of fluid supply means coupled by a synchronous shaft for supplying the same amount of fluid under pressure from the inputs thereof to the outputs thereof in proportion to the rotary angle of the synchronous shaft;

a fluid bypass circuit being interposed between the inputs and the outputs of the fluid supply means for connecting across each fluid supply means so as to bypass each fluid supply means, the fluid bypass circuit comprising normally closed solenoid valves;

an electric control circuit for actuating one of the solenoid valves when synchronous operation between the turntable and the carriage is released to thereby rotate one of the turntable or the carriage;

a first normally opened solenoid valve interposed between the first driving means and the fluid supply means;

a second normally opened solenoid valve interposed between the second driving means and the fluid supply means;

characterized in that the same amount of fluid under pressure is normally supplied from the fluid pressure generating source to the first and the second driving means, by the fluid supply means thereby allowing the rotary angle of the turntable to be synchronous with the rotary angle of the carriage;

or fluid under pressure is supplied from the fluid pressure generating source to only the first driving means or only the second driving means by selecting one of the normally closed valves and the second normally opened solenoid valve or one of the normally closed valves and the first normally opened solenoid valve, allowing the fluid bypass circuit to be opened by one of the normally closed solenoid valves and allowing the fluid bypass circuit to be closed by the second normally opened solenoid valve to thereby stop the supply of the fluid under pressure to the second driving means when only the first driving means is actuated or allowing the fluid bypass circuit to be opened by one of the normally closed solenoid valves and allowing the fluid bypass circuit to be closed by the first normally opened solenoid valve to thereby stop the supply of the fluid under pressure to the second driving means when only the second driving means is actuated.

* * * * *